US006288351B1

(12) United States Patent
Bruntz

(10) Patent No.: US 6,288,351 B1
(45) Date of Patent: Sep. 11, 2001

(54) TIMER KNOB ATTACHMENT

(75) Inventor: Jordan S. Bruntz, Baxter, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/471,615

(22) Filed: Dec. 21, 1999

(51) Int. Cl.[7] ..... H01H 3/10; H01H 19/14

(52) U.S. Cl. ..... 200/336; 200/38 R; 200/11 R; 200/564

(58) Field of Search ..... 200/4, 5 R, 11 R–11 J, 200/19.01–19.04, 17 R, 19.07, 19.08, 19.13, 19.15, 19.18, 19.2, 33 R, 36, 37 R, 37 A, 38 R, 38 A, 38 F, 38 FA, 38 FB, 564, 296, 329, 336

(56) References Cited

U.S. PATENT DOCUMENTS

| | | | | |
|---|---|---|---|---|
| 2,797,591 | | 7/1957 | Marrapese | 74/528 |
| 2,825,772 | | 3/1958 | Jones | 200/37 |
| 3,571,534 | * | 3/1971 | Ashman | 200/11 |
| 4,412,110 | | 10/1983 | Wojtanek | 200/38 |
| 4,892,982 | | 1/1990 | Hueber et al. | 200/38 R |
| 5,310,974 | * | 5/1994 | Churchill et al. | 200/566 |
| 5,684,281 | | 11/1997 | Amonett | 200/38 R |
| 5,954,192 | * | 9/1999 | Iitsuka | 200/336 |

* cited by examiner

*Primary Examiner*—Michael Friedhofer
(74) *Attorney, Agent, or Firm*—Zarley, McKee, Thomte, Voorhees & Sease

(57) ABSTRACT

A timer knob attachment is provided for an appliance having a control panel with a timer assembly mounted therein. A timer knob extends over the timer shaft to engage the spring arms on the end of the shaft. A locking pin extends rearwardly through the knob and into the timer shaft from the front of the control panel to lock the knob onto the shaft. A cap is mountable on the knob to cover the locking pin.

17 Claims, 3 Drawing Sheets

TIMER KNOB ATTACHMENT

BACKGROUND OF THE INVENTION

Household appliances such as clothes washers, dryers, and dishwashers, typically have a control panel with a timer assembly for controlling the operation of the appliance. A typical timer assembly is disclosed in U.S. Pat. No. 5,684,281 and is generally housed within the control panel. The timer assembly includes a timer shaft extending forwardly out of the front face of the control panel, with a timer knob mounted thereon. The timer knob is secured to the timer shaft by a locking pin extending forwardly through the locking shaft from the rear of the assembly so as to preclude the spring arms of the timer shaft from being withdrawn from the timer knob. This construction of the timer assembly requires access through the rear of the control panel to mount and remove the timer knob. This construction also complicates the attachment of external components to the timer assembly.

Accordingly, a primary objective of the present invention is the provision of an improved timer assembly for an appliance which permits quick and easy front attachment and removal of the timer knob to the timer shaft.

Another objective of the present invention is the provision of a quick and easy method of assembling a timer knob onto a timer assembly.

A further objective of the present invention is the provision of a timer knob which can be mounted onto a timer shaft from the front of the control panel without access though the rear of the control panel.

These and other objectives will become apparent from the following description of the invention.

SUMMARY OF THE INVENTION

A timer knob is provided for a timer assembly of an appliance. The appliance includes a control panel with the timer assembly mounted therein. The timer assembly has a shaft extending forwardly from the control panel. The timer knob mounts onto the timer shaft from the front of the control panel. A locking pin extends rearwardly through the knob and into the timer shaft from the front of the control panel to lock the knob onto the shaft. A cap is removably mounted on the knob to cover the locking pin.

The method of assembling the timer knob onto the timer assembly of the appliance control panel includes the steps of sliding the timer knob rearwardly over the timer shaft, and inserting a locking pin through a slot in the knob and into the timer shaft so as to lock the knob onto the shaft from the front of the control panel.

DETAILED DESCRIPTION OF THE DRAWINGS

Figure 1:
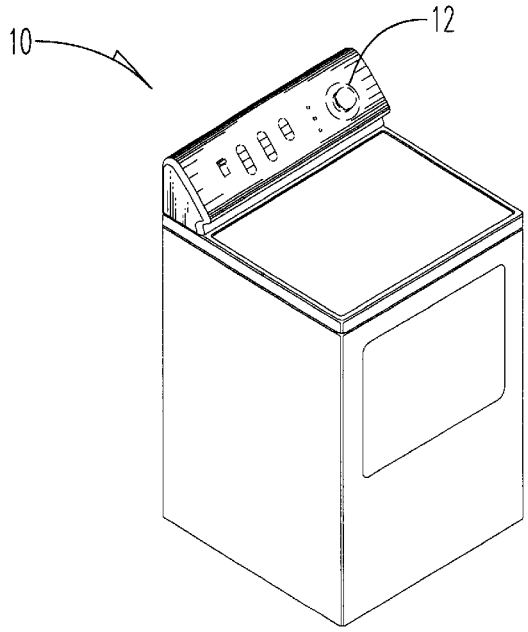
FIG. 1 is a perspective view of an appliance having the timer assembly and timer knob of the present invention.
Figure 2:
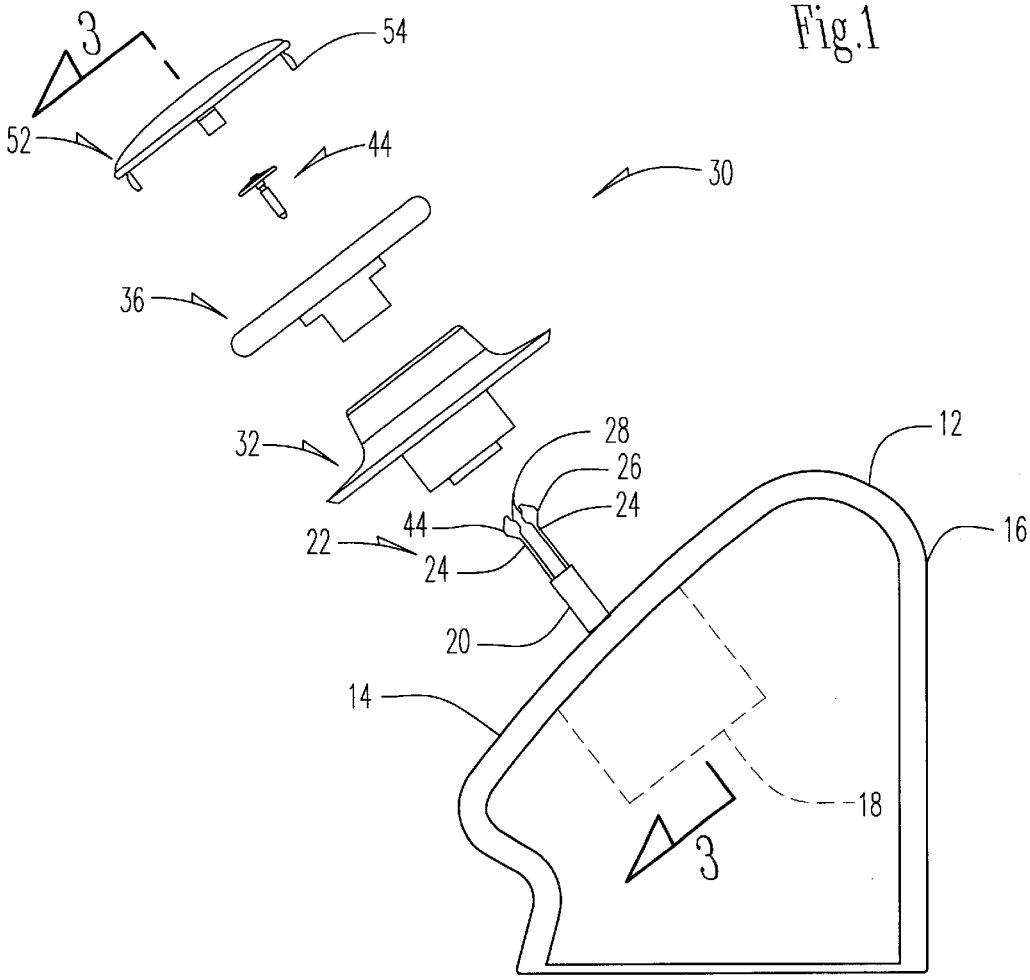
FIG. 2 is an exploded side elevation view of the components of the timer knob of the present invention.
Figure 3:
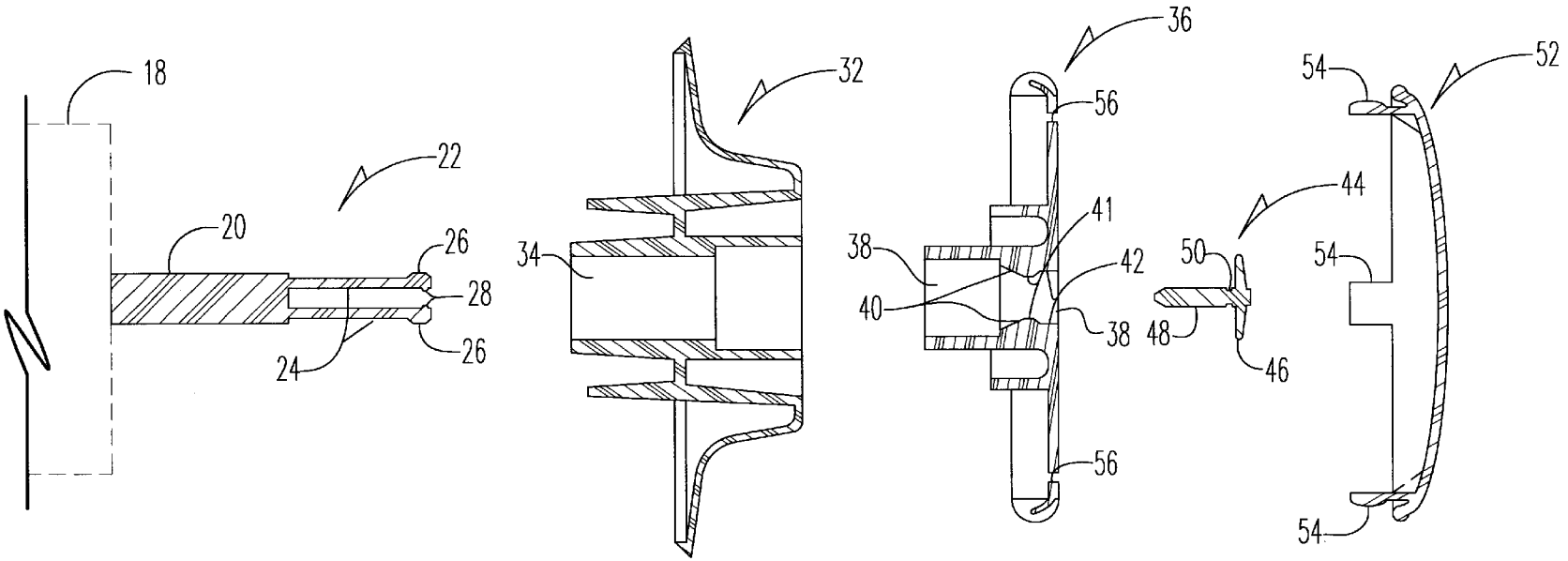
FIG. 3 is a sectional view taken generally along lines 3—3 of FIG. 2.
Figure 4:
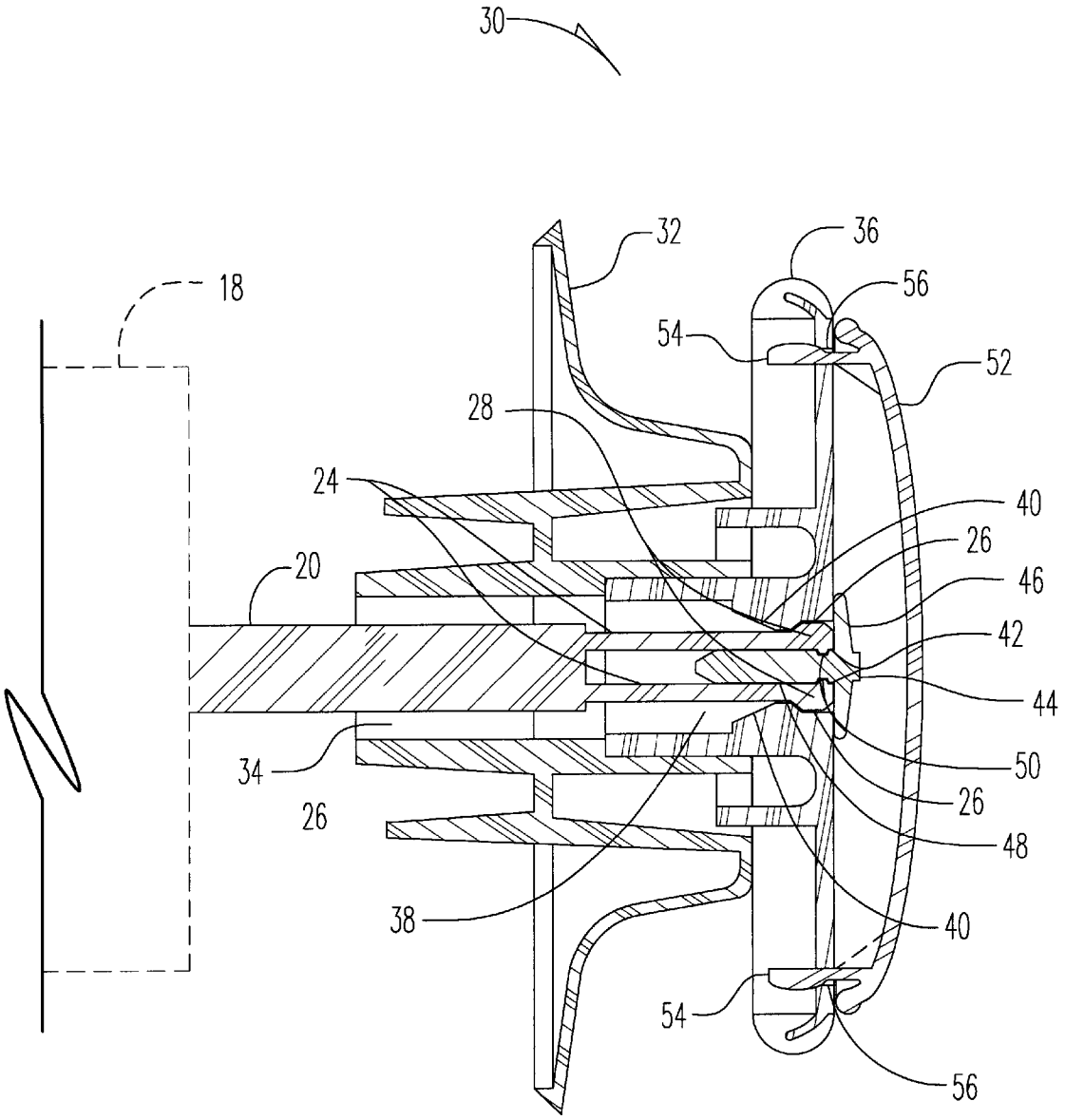
FIG. 4 is a sectional view of the assembled components.

An appliance such as a dishwasher, clothes washer, or dryer is generally designated by the reference numeral 10 in the drawings. The appliance 10 includes a control panel 12 with a front surface or face 14 and a rear surface 16. A timer assembly 18 is mounted in the control panel 12 in a conventional manner. The timer assembly includes a timer shaft 20 with a forward end 22 extending out of the front face 14 of the control panel 12. The end 22 of the timer shaft 20 includes a pair of spring arms 24 having external barbs 26 and internal ribs 28.

The appliance 10, control panel 12, and timer assembly 18 are conventional and do not form a part of this invention. An example of an acceptable timer assembly is sold by Mallory Controls of Indianapolis, Ind. which is a subsidiary of Emerson Electric Company of St. Louis, Mo. and is described in U.S. Pat. No. 5,684,281.

The present invention is directed towards a timer knob attachment 30. The timer knob attachment 30 includes a dial skirt 32 having a central bore 34 for mounting the skirt 32 onto the timer shaft 20. The bore 34 has a diameter greater than the diameter of the timer shaft 20.

The timer knob attachment 30 also includes a knob 36 with an axial bore 38. The diameter of the bore 38 is slightly larger than the diameter of the timer shaft 20. The bore 38 terminates in a reduced neck 40 having a shape corresponding to the shape of the spring arms 24. The neck 40 terminates in a slot 41 on the front face of the timer knob 36, with opposite cam surfaces 42 which are adapted to retentively engage the external barbs 26 of the spring arms 24 of the timer shaft 20.

A locking pin 44 is provided for locking the timer knob 36 onto the timer shaft 20. The locking pin 44 includes a head 46 and a shaft 48. A groove 50 is provided on the shaft adjacent the head 46. The shaft 48 of the locking pin 44 is adapted to extend through the slot 41 of the timer knob 36 and into the timer shaft 20, so as to prevent the barbs 26 of the timer shaft 20 from disengaging the cam surfaces 42 of the timer knob 36. The internal ribs 28 on the timer shaft 20 are adapted to engage the groove 50 on the locking pin shaft 48, so as to retain the pin 44 in its locking position.

A cap 52 is removably mountable on the timer knob 36 so as to cover the locking pin 44. The cap 52 includes a plurality of legs 54 adapted to extend through corresponding perimeter apertures 56 in the timer knob 36 so as to removably mount the cap 52 on the timer knob 36. It is anticipated that locking pin 44 and cap 52 could be combined and molded as one part.

The assembly of the timer knob attachment 30 of the present invention onto the timer assembly 18 is quick and simple. The timer assembly is installed on the control panel 12 in a conventional manner. The dial skirt 32 is then positioned on the timer shaft 20 from the front 14 of the control panel 12. The timer knob 36 is then slid into position on the timer shaft 20 such that the barbs 26 of the timer shaft 20 engage the cam surfaces 42 of the timer knob 36. The locking pin 44 is then inserted through the slot 41 in the timer knob 36 and into the timer shaft 20 such that the ribs 28 of the timer shaft 20 engage the groove 50 on the locking pin 44. Lastly, the cap 52 is mounted onto the timer knob 36 with the legs 54 of the cap 52 extending through the perimeter apertures 56 of the timer knob 36.

The assembly of the timer knob 36 onto the timer shaft 20 is all accomplished from the front 14 of the control panel. There is no need to have access to the rear 16 of the control panel 12 to install or remove the timer knob 36. The knob 36 is quickly and easily removed from the timer shaft 20 by removing the cap 52, pulling the pin 44 out of the timer shaft 20, and pulling the timer knob 36 from the timer shaft 20.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A timer knob attachment for an appliance having a control panel with front and rear surfaces, and a timer assembly mounted on the control panel with a timer shaft extending forwardly from the control panel, the timer shaft having a forward end formed of spring arms with external barbs and internal ribs, the attachment comprising:

a knob extending over the timer shaft; and a locking pin extending rearwardly through the knob and into the timer shaft from forwardly of the control panel front surface to lock the knob on the shaft.

2. The timer knob attachment of claim 1 wherein the knob includes an axially located slot for receiving the timer shaft.

3. The timer knob attachment of claim 2 wherein the slot has opposing cam surfaces to retentively engage the external barbs on the timer shaft.

4. The timer knob of attachment claim 3 wherein the pin includes a shaft having a groove to receive the internal ribs on the timer shaft.

5. The timer knob attachment of claim 3 wherein the pin includes a shaft and a head, the shaft extending rearwardly through the slot in the knob to prevent the barbs from disengaging the cam surfaces of the knob.

6. The timer knob attachment of claim 1 further comprising a cap removably mountable on the knob to cover the locking pin.

7. The timer knob assembly of claim 1 wherein the locking pin extends axially into the timer shaft.

8. The timer knob attachment of claim 1 wherein the pin is non-threaded.

9. A method of assembling a timer knob onto a timer assembly mounted on a control panel of an appliance, the timer assembly having a timer shaft, and the control panel having front and rear surfaces, the method comprising:

sliding a timer knob rearwardly over the timer shaft; and inserting a locking pin rearwardly through a slot in the knob and into the timer shaft so as to lock the knob on the shaft.

10. The method of claim 9 wherein the locking pin is inserted into the timer shaft from the front of the control panel.

11. The method of claim 9 wherein the locking pin is inserted axially into the timer shaft.

12. An appliance comprising:

a control panel for controlling the operation of the appliance, and having a front surface;

a timer mounted on the control panel and including a timer shaft extending forwardly on the front surface of the control panel;

a knob extending over the timer shaft; and a locking pin extending rearwardly into the timer shaft to lock the knob on the shaft.

13. The appliance of claim 12 wherein the timer shaft has spring arms, and the knob has an axially extending bore through which the spring arms extend.

14. The appliance of claim 13 wherein the locking pin includes a shaft extendable into the bore of the knob and between the spring arms of the timer shaft to prevent withdrawal of the spring arms from the knob bore.

15. The appliance of claim 14 wherein the spring arms include internal ribs and the locking pin shaft includes a groove into which the ribs engage.

16. The appliance of claim 12 wherein the locking pin extends axially into the timer shaft.

17. The appliance of claim 12 wherein the locking pin is non-threaded.

* * * * *